US005287109A

United States Patent [19]

Hesse

[11] Patent Number: 5,287,109

[45] Date of Patent: Feb. 15, 1994

[54] PROGRAMMABLE REMOTE CONTROL

[76] Inventor: David Hesse, 390 Dawes Road, Suite 1009, East York, Ontario, Canada, M4B 2E5

[21] Appl. No.: 726,236

[22] Filed: Jul. 5, 1991

[51] Int. Cl.[5] ..... G08C 19/12

[52] U.S. Cl. ..... 341/176; 340/309.15; 455/151.4

[58] Field of Search ..... 341/176; 340/309.15, 340/825.19, 825.69, 825.72, 321, 502, 504, 298, 636, 539; 358/194.1; 368/10; 360/33.1; 455/151.1, 181.1, 151.4; 359/142-148

[56] References Cited

U.S. PATENT DOCUMENTS 4,081,754 3/1978 Jackson ..... 455/181.1
4,121,160 10/1978 Cataldo ..... 340/321
4,162,449 7/1979 Bouyssounouse et al. ..... 340/539 X
4,689,785 8/1987 Toyonaga et al. ..... 370/85.3
4,718,112 1/1988 Shinoda ..... 455/151.4
4,906,972 3/1990 Spencer ..... 340/539

*Primary Examiner*—John K. Peng
*Assistant Examiner*—Thomas J. Mullen, Jr.

[57] ABSTRACT

An electronic remote control of the present invention controls timed functions of a device responsive to the control. The control has a processor with an input for entering command and time of command information for the function to be performed, a memory for storing the information entered at the input, a real time clock, a comparator for comparing time of the real time clock with the time of command information in the memory and an actuator for effecting a command signal for a particular command when the time of command information stored in the memory for that particular command matches the time on the real time clock.

4 Claims, 6 Drawing Sheets

DIGITAL TO INFRARED CONVERTER

PROGRAMMABLE REMOTE CONTROL

FIELD OF THE INVENTION

The present invention relates to an electronic remote control for directing a command signal to a device responsive to the remote control.

BACKGROUND OF THE INVENTION

It is well known in the electronics field for various electronic devices to be controlled by hand held remote control units, usually based on line of sight infra-red command signals. For instance, a television may be equipped with an infra-red receiver capable of picking up and responding to infra-red command signals transmitted by a hand held remote control unit. Similarly, VCR'S, CD players, tape decks, stereo units and other electrical-electronic equipment may all have their own individual remote control units. Typically, signals from one remote control unit will only control its associated device and will not control or affect other devices.

In order to eliminate a multipacity of hand held units, learning remote control units have been developed and are well known in the art. Such "learning remotes" are capable of memorizing and duplicating the infra-red commands of other remote control units which themselves may not be "learning remotes". In this fashion, one learning remote can memorize the commands of several remotes, thus allowing the use of a single, rather than several remotes.

According to even the most updates prior art remotes, including learning remotes, these are only operable in real time in immediate response to the manual commands of the user who pushes a key on the remote. In other words, if it is desired to change the status of the system in any way, e.g. change the channel on a T.V., etc., the user must specifically push the appropriate key or keys on the remote at the time that he or she wishes the change to occur.

Presently available remotes are not capable of directing commands to different devices on their own at different time intervals. A remote having such capabilities is very desirable particularly for people such as handicapped persons who are not capable of entering manual commands to a remote control. Without timed operation of the remote control such persons must rely on the assistance of others in order to assure timed operation of the device to be controlled by the remote.

SUMMARY OF THE PRESENT INVENTION

The present invention provides an electronic remote control for controlling functions and time of functions of a device responsive to the control. The control has a processor with an input for entering command and time of command information for the function to be performed, a memory for storing the information entered at the input, a real time clock, comparing means for comparing time of the real time clock with the time of the command information in the memory and actuator means for effecting a command signal for a particular command when the time of command information for that particular command matches the time on the real time clock.

The remote control of the present invention may be usable to control timed operation of various different devices in which case the input is settable for entering information for those different devices.

By way of example only, the control may be used to operate a T.V., a VCR, a sound system, etc. In the case of the T.V., the remote control may be set up to turn the T.V. on and off and/or switch channels at different times of the day without having to manually input the control when the changes are desired since the time for the changes have already been programmed into the remote control. The same is true when the control is used to operate a VCR where the time of the functions of the VCR would be preprogrammed into the control.

BRIEF DESCRIPTION OF THE DRAWINGS

The above as well as other advantages and features of the present invention win be described in greater detail according to the preferred embodiments of the present invention in which.

DETAILED DESCRIPTION ACCORDING TO THE PREFERRED EMBODIMENTS OF THE PRESENT INVENTION:

Very basically, the remote control device of the present invention is one which is capable of controlling the operation of various different appliances at predetermined times. By way of example only, the remote control device is capable of turning a T.V. on and off at various times of the day without requiring operator assistance. It win also switch between channels and is further capable of controlling the volume of the T.V.

By way of further example, the remote control of the present invention is capable of turning on and off a V.C.R. at certain specified times of the day and causing full operation of the V.C.R. including the playback of movies, etc., when both the V.C.R. and the T.V. have been turned on. This is to be distinguished from the standard recording of a program which can be presently carried out by a standard V.C.R. The control is additionally capable of determining or sensing whether or not the V.C.R. is actually in operation.

The remote control device of the present invention is capable of doing all of the above by the inclusion of certain unique features including a memory for entering commands including time of command information, a real time clock which keeps actual time of the day, a scanner for scanning information stored in the memory and comparing that information with the time on the real time clock and an actuator for effecting a command signal from the control device to an appliance which is remotely controlled by the device. The command signal is only effected when the time of command information in the memory matches the time on the real time clock.

Figure 1:
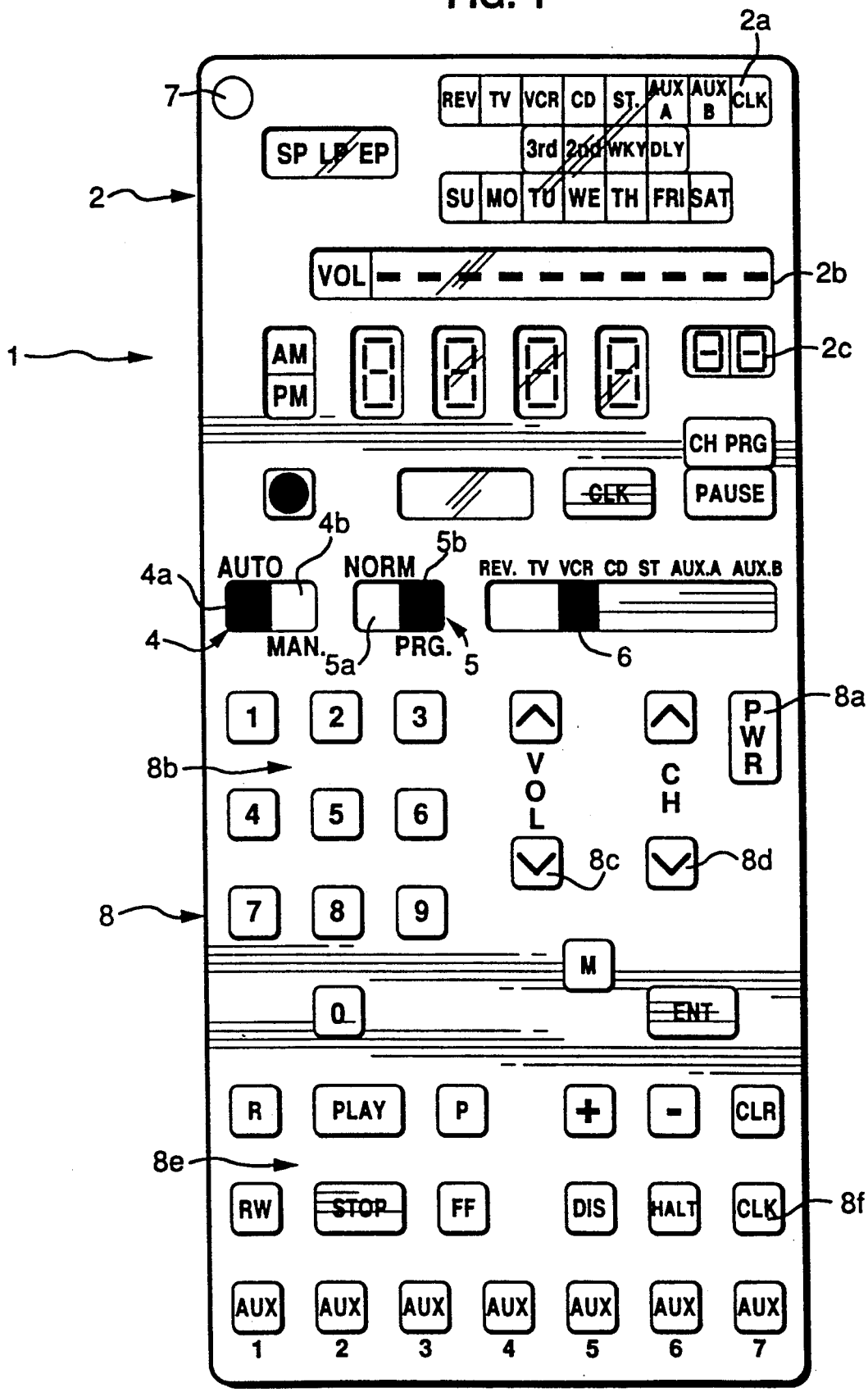
FIG. 1 is a plan view of a hand held remote control device according to a preferred embodiment of the present invention.

FIG. 1 shows a preferred embodiment example of a remote control device, generally indicated at 1. This remote control device includes an upper display region generally indicated at 2 and a lower keypad generally indicated at 8. The display region includes a first LCD display area 2*a* which includes visual displays for things such as the appliance selected, e.g. T.V., VCR, C.D.'s, etc., the day of the week and other programming features for the VCR. There is also a visual display 2*b* for the volume of the appliance selected, a visual display 2*c* which displays either real time or the channel selected depending on what has been requested by the user. Additional display areas can also be provided as required. Keypad 8 includes different hardware switches such as power on/power off switch 8*a*, numeric switches 8*b* used for example to select different television channels, volume control switches 8*c*, channel up and channel down switches 8*d*, VCR control switches 8*e* and a clock or time enter switch 8F. Again, other hardware switches can be provided as needed.

Remote control 1 can be used as a universal remote capable of learning and transmitting commands from a plurality of other different remote controls. For example, the command signals of a standard T.V. remote control, a standard V.C.R., a standard audio system remote control, etc. can all be feb into remote control 1 which then has the capacity to control the T.V., the V.C.R. and the audio system.

In addition to the above, remote control 1 can, by manual entries be programmed with specific user requests for different appliances to be operates automatically at different times, a feature unique to the present invention.

In order to enter the various different commands, remote control 1 is provided with a switch 5, settable in program setting 5*b* for learning the commands either from other remotes or from the operator as desired. Remote control 1 further includes an appliance selection switch 6 which is moved to the appropriate appliance setting for receiving the commands, i.e. T.V., VCR, CD player, etc. The commands from other remotes are fed in through an infra-red signal receiver 23 shown in FIG. 2. The user requested entries are inputted using the appropriate switches in keypad 8.

Control device 1 can direct the commands in either a manual mode or an auto mode. In the manual mode, switch 4 is moved to the manual setting 4*b* while switch 5 is moved to the normal setting 5*a*. The operator then simply points the device at the desired appliance and pushes on the appropriate switches to direct an infra-red command to the appliance.

Remote control 1 can also be used in an auto mode, where it directs commands to an appliance or to different appliances at preprogrammed times. The control is inputted with a sequence of commands which are carried out at scheduled times without having to manually operate the remote control. A particular appliance and time of the command is input in the programming mode as noted above. In order to automatically carry out the user inputted commands, switch 5 remains in the normal switch setting 5*a* and switch 4 is moved to the auto setting 4*a*. The remote without any further operator assistance then takes control of the appliance or appliances which have been programmed for control by the remote.

Figure 2:
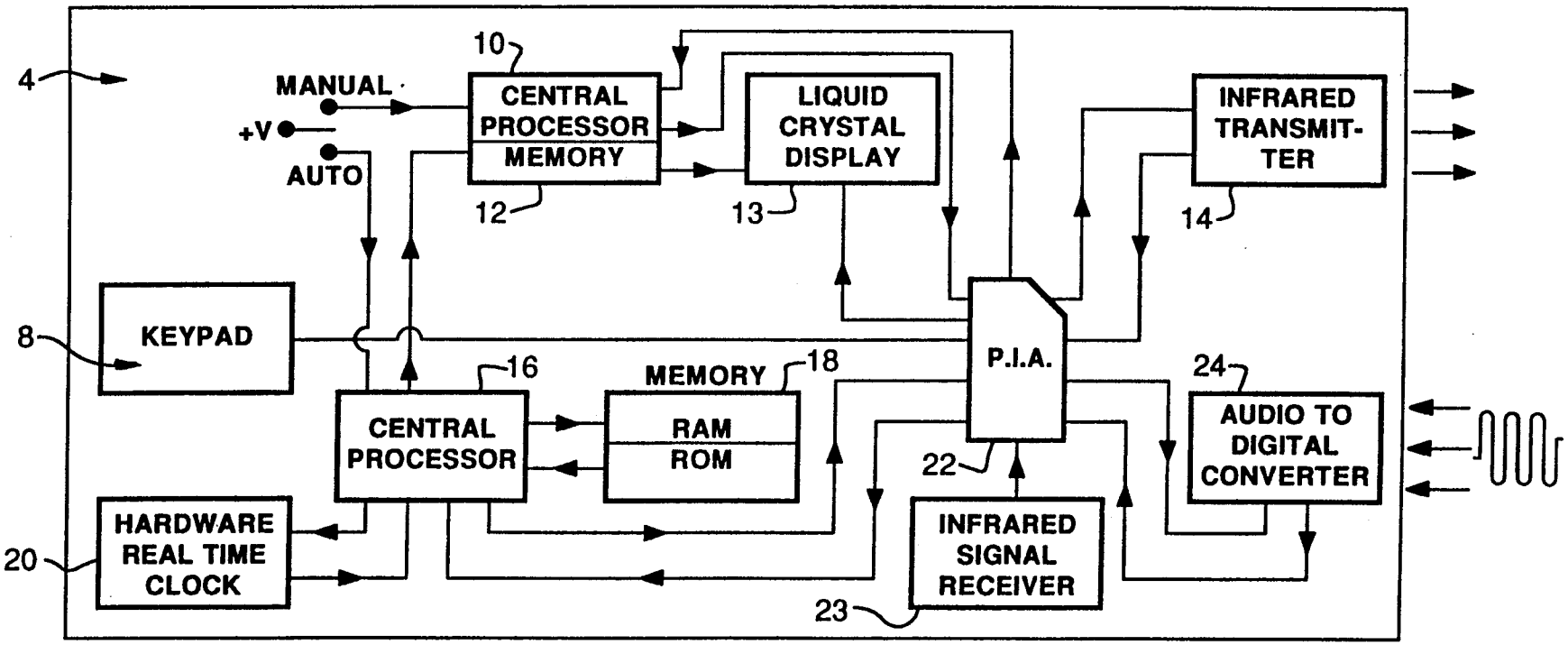
FIG. 2 is a more detailed schematic showing the internal set up of the hand held remote of FIG. 1.

The internal setup of the remote control is best seen having reference to FIG. 2 of the drawings. This figure shows the keypad 8 ana switch 4 with the circuitry for operation of the control in the manual setting being located to the upper part of the drawing and the circuitry for operation in the auto setting being located to the lower part of the drawing. The manual operation circuitry comprises a central processor 10 with a memory 12 for receiving and storing commands from other remote control devices or for storing user commands entered via keypad 8. The keypad inputs to the central processor via a peripheral interface adapter P.I.A. 22 which outputs to both central processor 12 and a digital to infra-red convertor and infra-red transmitter 14. Transmitter 14 sends a command infra-red signal to the appliance to which the signal has been tuned. The P.I.A. also outputs to liquid crystal display 13 for display region 2 which shows what information has been entered at the key pad switches 8.

In the FIG. 2 setup the circuitry for the operation of the remote in the auto setting includes a second central processor 16 having a memory 18 for storing of user input commands in the control. Additionally provided is a hardware real time clock 20, the peripheral interface adapter 22 common to both the manual and auto circuitry and an audio to digital convertor 14.

Memory 18 of processor 16 includes both a ROM—read only memory, which contains the operating program, and a RAM—random access memory, containing current update time clock with user programmed times. The RAM further contains channel information, devices to be used information, functions to be performed and information regarding the sequence in which the functions are to be executed. All of this information is entered to the RAM using the switches of the key pad.

The digital to infra-red convertor ana transmitter 14 is also common to both the manual and the auto circuitry. This digital to infra-red convertor takes a digital signal from the PIA dataline and converts it to an infra-red light transmission emitted by the infra-red transmitter 14. A receiver and audio to digital convertor 24 receives and converts audio signals from the appliance or appliances which have been turned on by the control and converts these audio signals to digital logic states. This receiver and convertor 24 is used as check to determine operation of the system as to be described later in detail.

The liquid crystal display is used as an interface between the user and either of the central processors to visually display or indicate specific information entered at the remote control. The liquid crystal display also shows what is actually occuring when the remote is set in the auto mode.

All the transmission of information between the various circuit components is accomplished by data bus lines connected between the components. The correct data is sent to the correct device by means of the address bus which is connected between components.

In the FIG. 2 setup, two central processors have been shown, one for the manual circuit and one for the auto circuit. In such an arrangement, processor 10 would be responsive to processor 16 when the system is set in auto mode. The two processor setup has been drawn simply to show substantially separate circuits for the manual and auto operation of the control. However, from a manufacturing standpoint the control can be more easily and less expensively built using one processor having the capacity of processor 16 for running both the manual and the auto circuits.

Figure 3:
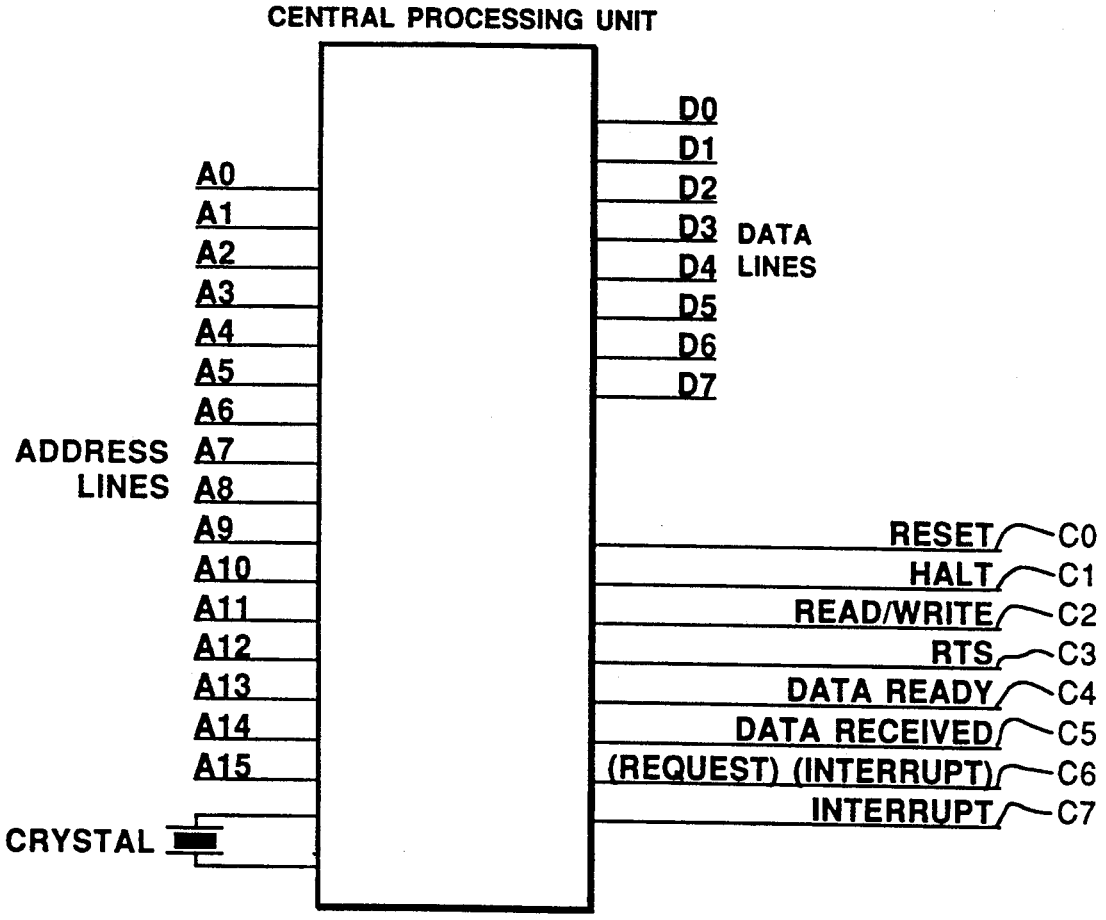
FIG. 3 is a schematic of a central processing unit used for the operation of the hand held unit of FIG. 1.

FIG. 3 shows more details of the central processing unit 16. This unit is a microprocessor and can be any eight bit commercially available processor available on the market today. In the example shown in FIG. 3, the central processor includes a series of address lines, A-0 through A-15. These lines are incremented internally by a program counter provided within the central processing unit. Also provided within the central processing unit's ROM is a memory MAP which is a map of all of the allocation of programmed data information and instructions. The read only memory is addressed to the central processor through a number of the first address lines that the central processor encounters, for example, address lines A-0 through A-4. This is the main operation program which instructs the central processor on all of its operations.

All of the information from the central processor is transmitted over its external pins referred to as data lines and shown at D0 through D7 in FIG. 3. There are also eight control lines C0–C7. One of these the read-write control line C6 indicates whether the information is being sent or received by the central processing unit. The control lines are special interrupt lines which halt normal operation of the central processing unit to address certain conditions. A failed attempt to turn on the appliance would cause what will be later described as the watch dog program to transmit along line C6, the request and interrupt line, an interrupt signal to cause the processor to execute special programming in an attempt to turn on the appliance. If this fails the central processor would cause an external light emitting diode 7 shown on the remote control FIG. 1 to light to indicate the failed start up attempt while proceeding to perform start up. Other control lines C0 and C1 reset and halt lines are connected to hardware switches and watch dog programs. They are used to switch the central processing unit into the auto mode which would reset the central processor in order to start it up in auto mode from the manual mode and also for a rebooting of the central processing unit during a software failure which might occur in the internal program of the user defined program. A hardware failure would also cause the rebooting process to occur and to be transmitted along reset line C0. An external crystal is used to control the clock frequency of the central processing unit.

Figure 4:
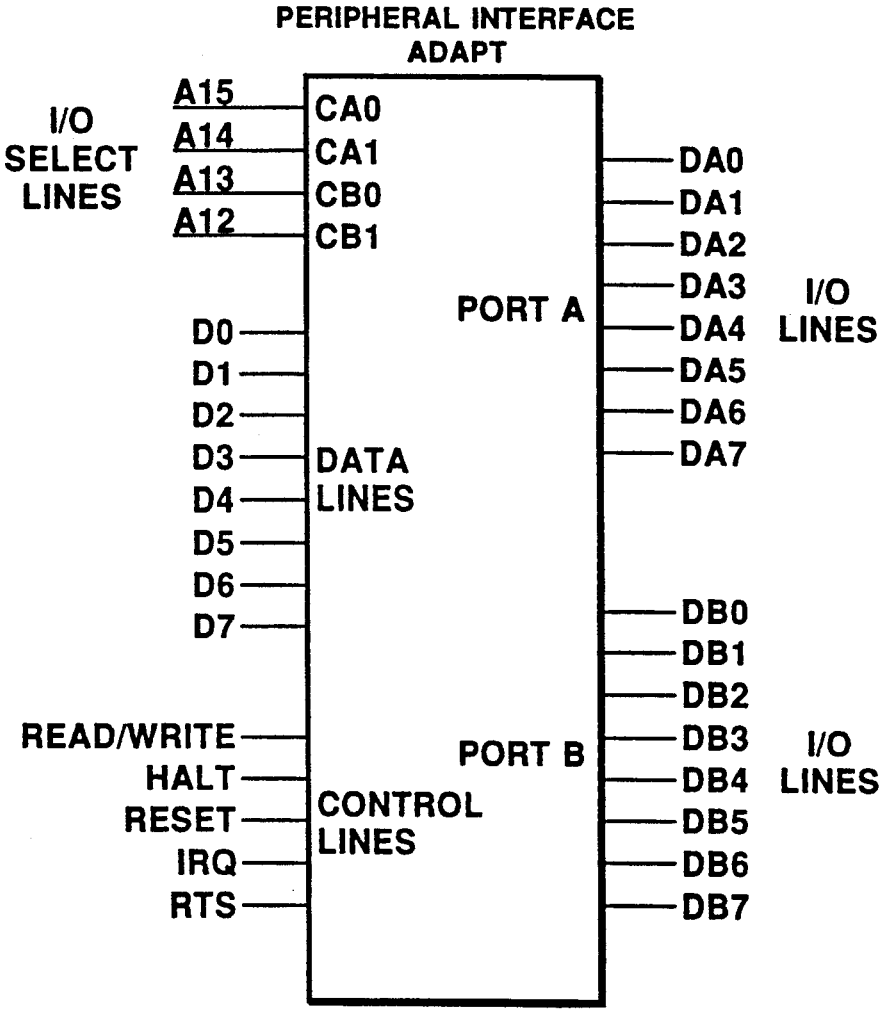
FIG. 4 is a schematic of a peripheral interface adapter from the remote control device of FIG. 1.

The peripheral interface adapter as shown in FIG. 4 of the drawings is used as a buffer between the central processing unit and the outside world. As seen in FIG. 4, the high address lines A-12–A-15 the data lines D0–D7 and certain ones of the control lines carry information between the central processor and the peripheral interface adapter which further includes two ports A and b seen in the drawings. There are eight external data bus lines indicated at DA0 through DA7 and DB0 through DB7. The lines can be programmed to be inputs or outputs for the central processing unit. They can be programmed individually or in groups. The key pad would use eight of these lines as inputs through the central processing unit. The other eight lines would be used as outputs to the liquid crystal display. One line would be used for serial transmission to the digital to infra-red convertor, another line would be used as input from the audio to digital convertor. The high order address lines, eg. lines A12 through A15 would select the designated data lines as inputs or outputs. The read-write line enables the inputs and the outputs as determined by the address lines. The information would be sent or received when toggled by control lines C4 data ready line, C3 ready to send line and C5 data received line from the central processing unit to the peripheral interface adapter to indicate a ready to send or ready to receive condition by the central processing unit. Hardware control lines would be used to enable the peripheral interface adapter during special interrupt operations and halt normal routine. C1 halt line would be enabled to halt regular programming during the time a command is transmitted to the digital to infra-red convertor via the PIA. During these times, communications to the digital to infra-red convertor and audio to digital convertor would be selected. In the write mode to the digital to infra-red convertor, all other operations would be halted. Only the central processing unit and memory by enabling halt line C1 would communicate to the peripheral interface adapter which would output a serial transmission to the digital to infra-red convertor. Once completed, normal operation would resume. The next operation of the peripheral interface adapter would be to select a designated line to read an internal photo detector provided in the remote control for the function of determining if a transmission was sent from the remote. If this occurred, the peripheral interface adapter would then be instructed to select another data line to read information from the audio to digital convertor. This information would be held in a buffer within the peripheral interface adapter until read from the central processing unit. Depending on the results of the information, the central processing unit would respond accordingly.

Figure 5:
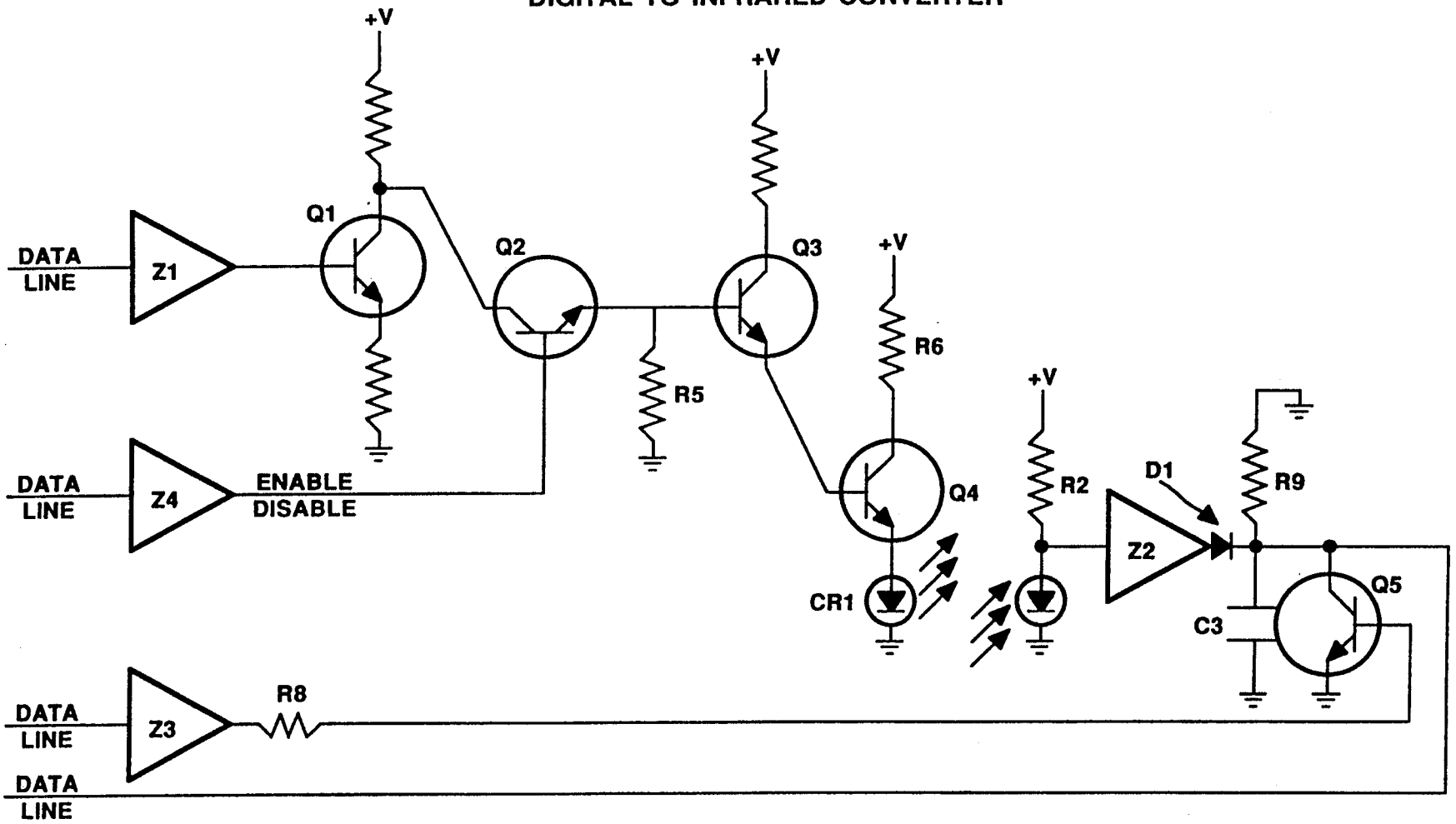
FIG. 5 is a schematic of a digital to infra-red convertor used in the remote control of FIG. 1.
Figure 6:
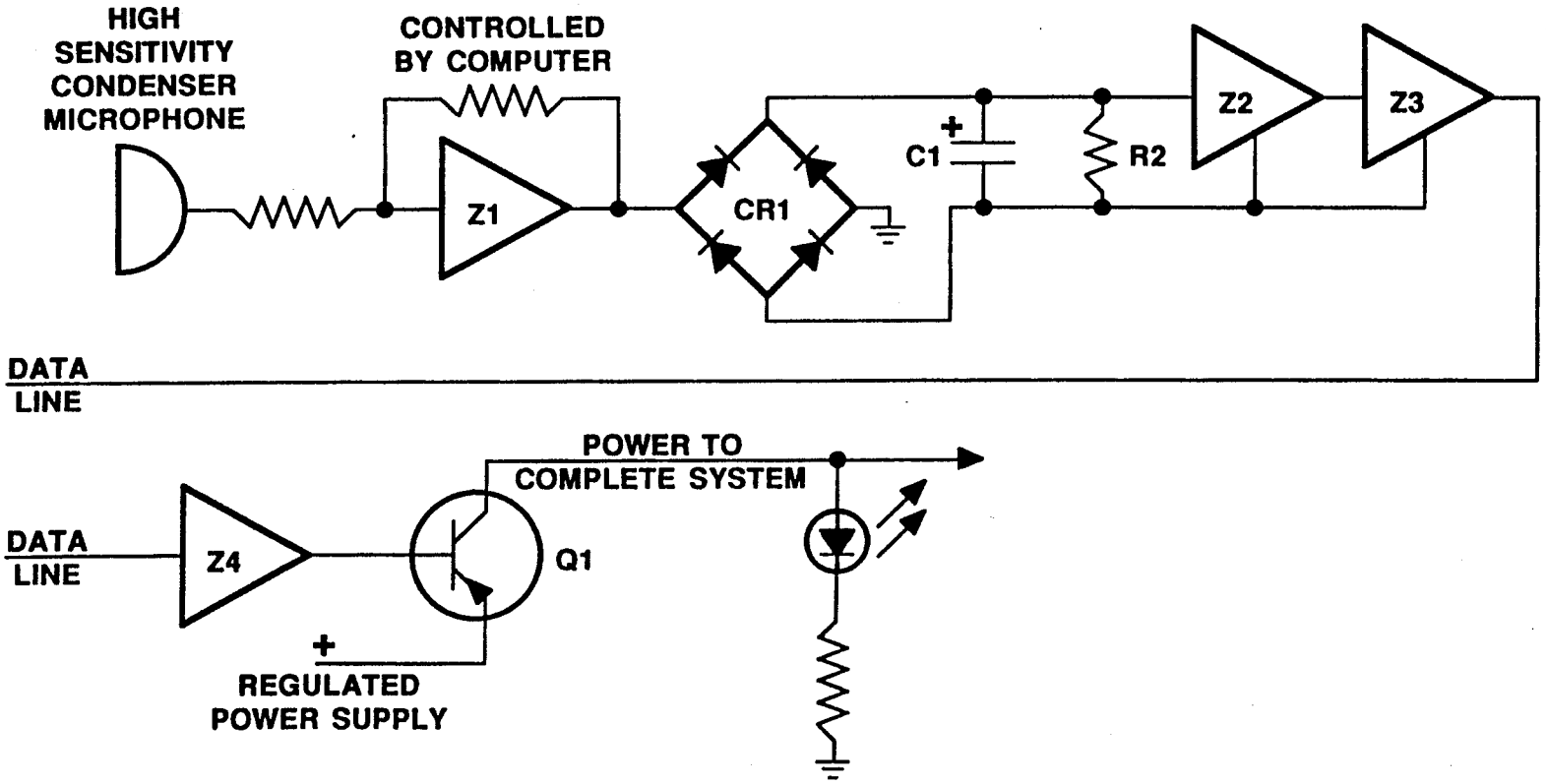
FIG. 6 is a schematic of an audio to digital convertor for the remote control unit of FIG. 1.

Also incorporated in the basic scanning and control routines are the functions of the digital to infra-red convertor and audio to digital convertor, specific examples of which are shown in FIGS. 5 and 6 respectively ana to be described later in detail.

Once the electrical appliance functions, sequence of events, and duration have been selected out of the random access memory, the central processor transmits this information to the peripheral interface adaptor which selects a buffer as an output port that is connected to the digital to infra-red convertor. The first information sent is a code which enables the digital to infra-red convertor to send infra-red information. A second stream of information is all the necessary codes to turn on the desired appliance, functions, sequence of events and duration. After this has been completed, the computer program will pause then after a period of time, the central processor will transmit information to the peripheral interface adapter which will in turn select one of its ports as an input that is connected to the audio to digital convertor. The audio to digital convertor wail listen for audio response from the recently turned on appliance. Assuming the central processor receives information via the peripheral interface adapter that an audio signal has been detected coming from the appliance and the computer then goes into what is referred to as a babysit mode waiting for the turn off time programmed into the control to match the time on the real time clock.

The digital to infra-red convertor as shown in FIG. 5 is the communication link between the computer and the electrical appliance or appliances. The digital to infra-red convertor consists of an invertor Z1 which acts as a buffer/driver between the computer data lines coming from the peripheral adapter to the first stage of amplification. Q1 is an NPN transistor which amplifies the weak digital signal from the buffer/driver to couple it to the second stage of amplification. Q2 is an enable/-disable transistor. Seconds before the computer is about to transmit a command code pulse, the computer issues an about to transmit command to Q2 via a data line from invertor Z4 from the peripheral interface adapter. This command turns on transistor Q2 which conducts as a pass transistor. The digital signal is then applied to the base of transistor Q3 which is in a darlington configuration with transistor Q4. The current gain from transistor Q1 amplification is sufficient to drive the base of Q3 which in turn drives transistor Q4. When the command pulse transmission is completed the computer issues a transmission complete command to transistor Q2 via a data line from the peripheral interface adapter. This turns off transistor Q2 which prevents further signals to be applied to the base of transistor Q3. Pulldown resistor R5 keeps the base of transistor Q3 reverse biased with respect to the emitter. Transistor Q3 is turned off by this which in turn reverse biases the base of transistor Q4 and stops any further conduction by that transistor. Transistor Q4 is direct coupled to the infra-red emitting diode CR1. Resistor R6 is a load resistor used to limit current flow through the infra-red light emitting diode. When the base of transistor Q4 is forward biased with respect to the emitter and the majority electrons flow through emitter/base junction to base/collector junction passing through resistor R6 to cause diode CR1 to be forward biased. The majority electron flow now occurs through diode CR1 which causes photon emissions from the device in the infra-red spectrum. This emission is directly proportional to the current flow through diode CR1. This system is now able to convert electrical digital pulse from the computer to digital infra-red light pulses. Transistor Q4, which is the power transistor, has sufficient current gain to drive the infra-red light emitting diodes CR1. A photo-diode CR2 is physically mounted at right angles to the infra-red light emitting diode CR1. When CR1 conducts, CR2 receives some of the photon emission. This forward biases CR2 which causes it to conduct. The conduction of CR2 pulls down the pull up resistor R2. With a low state on the input of the invertor its output switches to a logical high state. The output of invertor Z2 is then coupled to a read line on the data bus line. The computer reads the line after it is sent a transmission. Capacitor C3 has been charged up by the change of state of invertor Z2. The capacitor now fully charges is read by the computer. In the high state, the computer knows the infra-red transmission was successful. The computer then sends a ready to reset command to the invertor Z3. The output of invertor Z3 is toggled to a high state which is sufficient to forward bias the base of transistor Q5 with respect to its emitter. This causes transistor Q5 to conduct which discharges capacitor C3. Resistor R8 is an isolation resistor to prevent damage to the invertor during discharge of the capacitor. After a period of time, the computer stops the ready to reset which reverse biases the base of transistor Q5 with respect to its emitter. This stops conduction of transistor Q5. D1 is an isolation diode to prevent unwanted discharge of capacitor C3. Resistor R9 is a pull down resistor which keeps the capacitor discharged. With a low on the read line, the computer will execute its next series of instruction. If a failure has occurred during transmission, the capacitor would not have been charged. The computer would have read a low state and this would have caused the computer to go into a failed transmission routine encompassing flashing of the light emitting diode and halted computer program execution.

The audio to digital convertor as shown in FIG. 6 of the drawings is the sensory feedback for the control. It links a feedback path between the computer and the appliances. The audio to digital convertor consists of a high sensitivity condensor microphone. The presence of sound waves will be converted to an electrical signal. This signal is fed to an operation amplifier Z1. Amplifier Z1 has an adjustable gain. Potentiometer R1 varies the gain of the operational amplifier through its feedback network. The gain will be increased or decreased by the central processor. This provides a means of making the system more selectable to different audio levels. The amplified audio signal is then fed to a full bridge rectifier CR1. The bridge converts the AC signal to a pulsating DC voltage. The rectified voltage is fed to capacitor C1. The capacitor C1 serves to filter the ripple content in the DC voltage and also average the signal over time. The main purpose of this system is to detect a presence of audio sound waves. The capacitor win charge over time and win discharge over time. The charge time of the capacitor is small compared to the long discharge time. The capacitor is charging only when audio sound waves are present. Once charged, the capacitor will maintain that charge regardless if sound waves are present or not. This is due to the circuit design. A discharge resistor R2 is placed in parallel with capacitor C1. As long as audio sound waves are present, capacitor C1 remains charged. In the absence of sound wave, capacitor C1 will start to discharge through resistor R2 over a period of time. This will continue until the capacitor is fully discharged. The purpose of this is to have the ability to determine the presence of audio sound waves. A charged capacitor indicates a presence of audio sound waves. A discharged capacitor indicates an absence of audio sound waves. Resistor R2 has a value which causes the capacitor to discharge slowly. This value win translate to, for example, a time constant of five seconds. Since the capacitor takes five time constants to fully discharge it requires twenty-five seconds of no audio sound waves to completely discharge the capacitor. This delay is to average out periods when there is a pause in talking on a program or show. Although the appliance is on, a pause in the sound could fool the remote control into thinking that there is a failure in the appliance. By averaging over time the discharge of capacitor C1, the problem of quiet periods in a show is solved. If after twenty five seconds no audio sound wave is present, the control will assume a failure in turn on of the appliance or a failure of the appliance during operation. This would enable the watchdog program to correct the failed condition.

Capacitor C1 is connected to the input of invertor Z2. A charged capacitor will cause the output of the invertor to be low or zero. A discharged capacitor will cause the output of invertor Z2 to be high or five volts. The output of Z2 will be applied to another invertor Z3. The output on this invertor is phase shifted by 180° and is applied directly to a data bus line to be read by the control processor through the peripheral interface adapter during sensory feedback routines. Transistor Q1 is a pass transistor which applies power to the entire system prior to actual infra-red transmission on a schedules program. After the control has enabled the infra-red transmittor, the control sends a high signal on one of the data bus lines to the peripheral interface adapter. The adapter acts as an output on this line. The high signal is applied to the invertor/buffer Z4. The output of the invertor is a low signal. This is applied to the base of transistor Q1 which forward biases the base emitter junction. Regulated power supply voltage on the emitter side now conducts through the transistor and supplies the necessary power to run the audio to digital convertor. Once power is applied, a light emitting diode or actuated segment on the display may be used to indicate this turn on condition of the audio to digital convertor.

The unit operates as follows:

PROGRAMMING MODE

The central processor receives information from the key pad such as the date and time an electrical appliance should be turned on, e.g. T.V., V.C.R., stereo, CO player or combination of electrical appliances; the time that the device should be turned off; the device to be turned on or combination of devices, e.g. T.V. alone or T.V. and V.C.R. or stereo or stereo and C.D. player, etc.; the functions to be actuated after selected devices are turned on, e.g. volume, station channel, color, brightness, play rewind, stop/record, disk play selection, etc. This information is written to the random access memory as part of the scanning routine performed by the main program found in the read only memory.

In the normal mode, the remote would behave as a typical hand held remote control. By switching it to the auto mode, the remote would take control of the total operation of any appliance or appliances which have been programmed into and stored in the random access memory. The basic scanning and control routines would operate as follows. Software is provided in some basic language program necessary to scan all program entered information on which the central processor will determine when a desired time has occured, for what electrical appliance, what functions win be activated, the sequence and the duration of activation. After all necessary functions have been completed, then the control goes into a babysit mode and literally watches the real time hardware clock until duration time for the particular occurrence, which then causes the central processor to execute the sequence of functions necessary to shut the appliance off or switch to another program or another combination of appliances. This sequence of events is totally up to the programming by the end user.

After the correct sequence of functions have been performed for shut down, the central processor returns to scanning of desired turn on times ana comparing them with the real time clock waiting for the next event to occur.

The following is an example of a routine for starting up a programmed show. The remote control would operate on normal turn on software procedures. If there is a first unsuccessful attempt of a turn on procedure, a special counter counts this attempt and an interrupt along C6 would cause the remote control to execute turn on procedure again. This would include turning the volume up to ensure that it is sufficiently loud to be heard by the audio to digital convertor, if no high state found on read then the central processor will issue a turn on command, followed by volume down then once again volume up procedure. If after a second turn on attempt there is still no high state found on the read from the audio to digital convertor, the special counter would increment by one again and a third execution of the turn on procedure would occur. If after the counter reaches a predetermined maximum number of attempts and no successful turn on has been completed, the control assumes that the appliance is disabled. It would attempt the turn on procedure on a regular timed interval until the end of the programmed sequence of events.

Before the control starts a second complete turn on procedure, it tests the mute status. In some televisions, the mute control when activated over-rides the volume up or volume down command and stays activated. After a failed first attempt by the volume up and down commands, as described above, the control will send a command code for mute, via the peripheral interface adapter to the digital to infra-red remote convertor. The control will then read from the audio to digital convertor via the peripheral interface adapter. If a high signal is present, the control will send a command code for basic volume down then volume up procedure. The control will then read again from the audio to digital convertor via the peripheral interface adapter and resume normal turn on procedure. On the other hand, if a low signal is present, the control will send a command code to restore the mute to its original state and the central processor will then perform the complete turn on procedure a second time.

If the central processor senses a failed condition, a special interrupt command is enabled along line C7 from the central processor which then sets a timer circuit to oscillate the light emitting diode 7 on the device that there has been a failed communication between the control and the appliance. This condition would be enabled until the control program regains control of the specified appliance which would then cause the interrupt C7 to be disabled and disable the timer/light emitting diode.

One of the unique features of the present invention is the set up of the remote to operate using sensory feedback. The programmable control sends a command and is able to determine if the command was received by the target appliance and if the appliance acted upon the command. The control continues to command the target until the command is completed and fully executed. If there is a failure of the appliance then the control reissues the command. This is the watchdog invention referred to earlier.

In the examples given above, the control uses audio sound waves as the sensory feedback. However, different types of sensory feedback could equally as weir be used. For example, infra-red, electrical pulsing, electromagnetic ultra-sonic radiation, radio frequency transmission, and/or telemetry sensory feedback could be used. Each and every one of these forms of physical transmission would indicate to a programmable unit whether its command was received and acted upon. The uniqueness of the feedback is that audio sound is universal and not just dedicated to a particular type of appliance.

The system is also a safeguard against transmission failure by the control itself. During any infra-red transmission by the control a photo detector bunt inside the head of the control takes a sample of the actual infra-red light transmission. The voltage produced by the sample is fed back through to the central processing unit. If for some reason the light transmission failed, the sampling would show a change of state on the line and as earlier described set an interrupt on the central processing unit interrupt to stop all execution with a resultant flashing display indicating a failed condition. This would persist until a manual over-ride was enabled by the end user, which would cause the central processor to reset CO.

The system programming is done by the end user. All the information necessary for operation is prompted by the remote control. The liquid crystal display shows the number of devices ana auxillary devices. A plus and minus switch on the key pad causes each device to be highlighted in an ascending or descending order. This depends on which push button switch is actuated. More than a single appliance can be selected at one time. The order in which the appliances are selected determines the order in which they are turned on. Once the user has highlighted his choice the enter push button is actuated. If no more appliances are to be added the end user would actuate the program push button switch to enter this in the memory actuating the next programming function. This would be user defined and completely flexible. The user would simply press the push button of the appliance that he or she wants to control and after that would press the particular function for that appliance. The device and function would be highlighted on the liquid crystal display.

The device can further include a bar graph and pause blocks. The bar graph would be used to set a specific level for something, eg. volume on a T.V. The pause blocks would be used to enter physical time delays after the function has been actuated. Anything directly following the pause block would not occur until the pause block has expired.

The remote control of the present invention has numerous applications. It is particularly important to handicapped persons who are not otherwise able to manually operate a conventional remote control. Further it can be used by parents to schedule T.V. shows and the like to be watched by young children.

As a safety feature, the control is able to turn on and off different appliances at different times of the day in the event that the home is unattended for extended periods of time.

According to a further aspect of the present invention, the control may be built as an onboard control in a television set where once again full operation of the television set to turn on and off at different times of the day, to change channels and to even raise and lower the volume for different shows and the like are easily achieved by building an onboard control directly within the T.V.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. An electronic remote control device for controlling timed functions of an appliance responsive to said control device, said control device having a processor for controlling operation of said control device, an input for entering command and time of command information for a function to be performed, a memory for storing the information entered at said input, a real time clock, comparing means for comparing time on said real time clock with the time of command information in said memory, actuator means for effecting a command signal to be communicated to said appliance when the time of command information for a particular command matches the time on said time clock, and a feedback pickup sensitive to output from the appliance for receiving both on/off and level of output information from the appliance indicative of whether a command signal from the control device has been successfully communicated thereto, said feedback pickup having means to indicate a failed command signal and said control device being responsive to such feedback pickup to reenter commands when said filed command signal is indicated by said feedback pickup.

2. A remote control device as claimed in claim 1, wherein said feedback pickup is sensitive to audio frequency signals.

3. A remote control device as claimed in claim 2, further including an audio to digital convertor for converting audio frequency signals received at said feedback pickup to digital signals which are read by said processor.

4. An electronic control system for controlling timed functions of an appliance, said control system including a control device, said control device having a processor for controlling operation of said control device, an input for entering command and time of command information for a function to be performed, a memory for storing the information entered at said input, a real time clock, comparing means for comparing time on said real time clock with the time of command information in said memory, actuator means for effecting a command signal to be communicated to said appliance when the time of command information for a particular command matches the time on said real time clock and a feedback pickup sensitive to output from the appliance for receiving both on/off and level of output information from the appliance indicative of whether a command signal from the control device has been successfully communicated thereto, said feedback pickup having means to indicate a failed command signal, and said control device being responsive to said feedback pickup to reenter commands when said failed command signal is indicated by said feedback pickup.

* * * * *